US007044138B2

(12) United States Patent
Brown

(10) Patent No.: US 7,044,138 B2
(45) Date of Patent: May 16, 2006

(54) MULTI-PURPOSE HAIR HIGHLIGHTING COMB AND METHOD OF USE

(76) Inventor: Kari Brown, 5660-9th St. SE., St. Cloud, MN (US) 56304

( * ) Notice: Subject to any disclaimer, the term of this patent is extended or adjusted under 35 U.S.C. 154(b) by 226 days.

(21) Appl. No.: 10/752,349

(22) Filed: Jan. 6, 2004

(65) Prior Publication Data

US 2004/0168697 A1 Sep. 2, 2004

Related U.S. Application Data

(60) Provisional application No. 60/439,845, filed on Jan. 14, 2003.

(51) Int. Cl.
*A45D 24/04* (2006.01)
*A45D 24/38* (2006.01)

(52) U.S. Cl. ..... 132/139; 132/161

(58) Field of Classification Search ..... 132/139, 132/141–144, 148, 137, 125, 124, 160–161, 132/901, 219; 15/142; D28/33–41, 21–24
See application file for complete search history.

(56) References Cited

U.S. PATENT DOCUMENTS 3,181,540 A * 5/1965 Abraham ..... 132/159
3,349,781 A 10/1967 Poole et al.
3,552,403 A * 1/1971 Sestito ..... 132/150
4,165,754 A 8/1979 Di Pasqua
4,566,472 A * 1/1986 Mueller et al. ..... 132/112
4,996,996 A * 3/1991 Hirsh ..... 132/160
5,018,542 A * 5/1991 Lee ..... 132/139
5,152,306 A 10/1992 Stephan
5,231,999 A * 8/1993 Schroettner ..... 132/137
5,337,765 A 8/1994 Wong
5,562,111 A 10/1996 Torres
5,626,153 A 5/1997 Petrarca
6,079,420 A 6/2000 Musum

* cited by examiner

*Primary Examiner*—John J. Wilson
*Assistant Examiner*—Robyn Doan
(74) *Attorney, Agent, or Firm*—Patterson, Thuente, Skaar & Christensen, P.A.

(57) ABSTRACT

A hairstyling comb in which a plurality of elevated notched major comb teeth are provided to lift and entrain strands of hair which are subsequently to be treated with hair treatment, such as highlighting colorant. Between adjacent major comb teeth are one or more minor comb teeth, providing spacing between the major comb teeth and a place for the unselected strands of hair to be separated and held. The upper surface and lower surface of the hairstyling comb contain differently sized major comb teeth and notches, and the end of the comb contains one large notch. A hairstyling kit that includes the hairstyling comb, hair clips, applicator brush, foils, container adapted to hold a liquid, and instructions for the use of the hairstyling comb.

7 Claims, 6 Drawing Sheets

MULTI-PURPOSE HAIR HIGHLIGHTING COMB AND METHOD OF USE

CROSS REFERENCE TO RELATED APPLICATIONS

This application claims priority to U.S. Provisional Patent Application Ser. No. 60/439,845, filed Jan. 14, 2003 which is herein incorporated by reference.

FIELD OF THE INVENTION

The present invention generally relates to hair highlighting methods and tools.

BACKGROUND OF THE INVENTION

Hair highlighting is a process for selectively coloring strands of hair. Highlights consist of selecting small or thick strands of hair that are lightened, darkened or colored a different shade than the rest of the hair. The process also known as tipping, weaving, frosting or streaking, consists of applying color directly to the hair or using bleaching chemicals to bleach away some of the natural hair pigment. Traditionally, highlighting has been performed in beauty salons by professional stylists.

One of the methods for highlighting hair is described in U.S. Pat. No. 5,562,111. This method includes a full cap tightly fitted over the head over combed-back hair. The hair is pulled through holes in the plastic or rubber cap with a fine crochet hook and the exposed hair is colored to create the effect of contrast or highlight. The necessity of drawing hair through individual holes in the cap makes it difficult for the hair technician to consistently draw out a strand of hair from a desired area without unintentionally entraining undesired strands of hair from areas surrounding the hole making for unpredictable end results. Secondly the highlighting patterns available are dictated by the distribution of holes in the cap. Additionally, coloring the hair roots, preventing bleeding of color to adjacent hair strands particularly at the hair roots, are other disadvantages of this method. U.S. Pat. No. 4,165,754 is another example of a hair highlighting method using the cap method.

Alternatively, the combing method of applying a hair treatment involves a comb, which is dipped into the treating liquid, and then pulled through the hair to be treated. Only relatively large swatches of hair can be treated in this manner and it is difficult to avoid bleeding of the treating liquid to those parts of the head that are not to be treated. U.S. Pat. No. 3,349,781 describes a method where a hair stylist parts hair into sections and uses a brush with a series of spaced tufts to brush streaks onto the strands of hair. The tufts of the brush are dipped in a hair colorant and retain the hair colorant until the brush is drawn across the strands of hair that are to be colored, thus depositing the colorant onto the selected hair. This method utilizes protective sheets placed under and over the strands before and after coloring the hair to prevent color bleed to adjacent strands. The width of the tufts and the spaces between tufts of the brush determine the width of the streaks brushed onto the hair. However, using this brush method makes it difficult to choose which strands of hair will be subject to the hair treatment. Hence, there is less control over the placement of the hair treatment and larger sections of hair are treated, resulting in a more unnatural effect.

U.S. Pat. No. 5,337,765 describes a modular brush for applying dye or color, with a brush body and detachable bristle modules so that the user can configure the brush to achieve a user defined highlighting pattern. Here, too, the use of a brush presents some difficulty in choosing and limiting which strands of hair are subjected to the hair treatment. The use of a brush results in less control over the placement of the hair treatment and, consequently, larger sections of hair are treated resulting in a more unnatural effect.

Another method for highlighting is by using a conventional rattail comb to section and separate hair to be highlighted. A rattail comb is a comb having conventional teeth, and a tapered, pointed extension or "rattail" extending from the portion of the comb with the teeth. In a hand weaving method using a rattail comb, a hair stylist forms or creates a section of hair by defining a thin rectangular like section of the scalp with the pointed end of the tapered rattail extension. The rattail extension is weaved in and out of the thin section of hair in an up and down weaving manner sectioning the hair into a section to be eliminated from highlighting woven below the rattail extension and a section to be highlighted woven above the rattail extension, this section is laid onto foil for highlighting.

The foil confines the hair so that the hair is controllable and separates and protects the confined hair to be chemically treated from hair that is to retain its natural color. After one section of hair is weaved and color is applied, the hairstylist moves on to create another section of hair, which is weaved and colored, and proceeds to repeat the process until the entire head of hair has been sectioned, weaved, and colored. The hand weaving method with the rattail comb is time consuming and requires a great deal of expertise because it is difficult to weave uniform sections in terms of sizing and spacing as well coloring consistency.

An example of foil highlighting is described in U.S. Pat. No. 5,152,306, and is herein incorporated by reference. The highlighting process is described, along with the use of a hairdressing comb. Here, a hairdressing comb is provided which has hair-lifting teeth. Each hair-lifting tooth has a barb or hook-like formation at the free end of the tooth. There may be one or more plain comb teeth in-between the hair-lifting teeth, providing the spacing between the hair strands that are to be treated with colorant. A section of hair is scaled out and held as the hairdressing comb is drawn through the section of hair, with the hair-lifting hooked teeth lifting strands of hair away from the section of hair. These lifted strands of hair are then covered with highlighting preparation and covered in foil. The comb must be manipulated so that the hair strands slide to the closed end of the hook and yet do not become tangled on the barb or hook-like end of the tooth. If the hair becomes entangled, the user can start the process over or can apply the hair treatment with the possibility that a larger area than planned will be treated, due to the tangled hair.

Another application comb is described in U.S. Pat. No. 5,626,153, where one side of the spine of the comb contains plain comb teeth and the other side of the comb spine contains major teeth separated by major grooves. The hair is combed and the hair that is located in the major grooves is the hair that will be treated. Each major tooth has a bore in it, towards the base of the tooth, near the spine of the comb. In one embodiment, the bores are aligned such that a shaft is positioned through the bores (via a sliding shaft in the handle of the comb), thus trapping the hair positioned in the major grooves. This hair can then be manually grasped for further manipulation. The need to slide the shaft into place to trap the hair and then to slide the shaft back to release the hair makes the comb somewhat complicated to use. In addition, it may be possible for the hair to get caught in the grooves or by the sliding of the shaft.

Another approach to hair highlighting is to utilize special hair combs to permit sectioning of hair and application of the color treatments. U.S. Pat. No. 6,079,420 describes a comb for treating hair by either a professional hair stylist or a non-professional. The comb includes tines with retaining areas between adjacent tines for retaining treatment material, such as highlighting gel. The comb also includes pairs of forked teeth at the free ends of the tines and channels to guide the hair not being treated away from the retaining area. In use, the comb is swiped through the hair and the hair is channeled between the tines so that the hair receives treatment material that has been previously charged in the retaining areas. There is little control as to how much of the treatment material is applied to any given section of hair. More likely, the part of the hair in first contact with the comb will receive a greater coating of the hair treatment, with the hair strand ends receiving a lighter coating of the treatment. This method can result in uneven application and an unnatural-looking effect.

Many of the methods described above do not provide control over which strands of hair are treated with the hair treatment material and which strands are not treated with the hair treatment material. In addition, methods that appear to provide more control over which hair strands are treated with hair treatment may also be more difficult for a user to use on their own head of hair.

SUMMARY OF THE INVENTION

There is a need for a device or tool that addresses the above described needs. The present invention provides the hair highlighting market and consumer an improved tool and kit for at-home highlighting of hair. In particular, the present invention provides a device that will allow the user to easily section the hair as desired, the ability to further sub-section each section of hair to control the thickness of the highlights and allows ease of coloring each of these subsections. It should be noted, however, that the highlighting comb of the present invention is not necessarily limited to highlighting and can be used to section hair in preparation for other hair treatments such as coloring, bleaching and any other related use of hairstyling or treating hair.

The multi-purpose comb of the present invention substantially meets the aforementioned needs of the industry. According to the present invention there is provided a hairstyling comb and method of using the comb that simplifies the foil process of hair highlighting and provides the at-home consumer the opportunity to get salon results at a fraction of the salon price in the convenience of their home. Each side of the hairstyling comb has a different construction. The rattail portion allows sectioning of the hair into large sections while the notches on the major comb teeth allow the user to further sub-section the larger sections of hair to prepare it for a foil color. Depending on whether natural looking highlights or chunkier or thicker highlights are desired, the side of the comb with the smaller notches or the side of the comb with the bigger and deeper notches is used. The comb also provides a section that allows for the creation of very thick highlight pieces. Multi-colored highlights can be created by applying different hair colorants to the various strands of hair sub-sectioned by the comb. The spacing between the major comb teeth provides control over the distance between highlighted strands of hair. Minor comb teeth are located in-between the major comb teeth and may serve to keep orderly and separate the combed hair that is not to be treated from the hair that is to be treated.

The present invention includes a highlighting kit that comprises the hairstyling comb of the present invention, a container adapted to hold a liquid, hair clips, foils, an applicator brush, and instructions for the use of the comb.

BRIEF DESCRIPTION OF THE DRAWINGS

The above and other features, aspects and advantages of the present invention will become apparent, as will a better understanding of the concepts underlying the present invention, by reference to the description that follows and reference to the accompanying drawings in which.

DETAILED DESCRIPTION OF THE DRAWINGS

Figure 1:
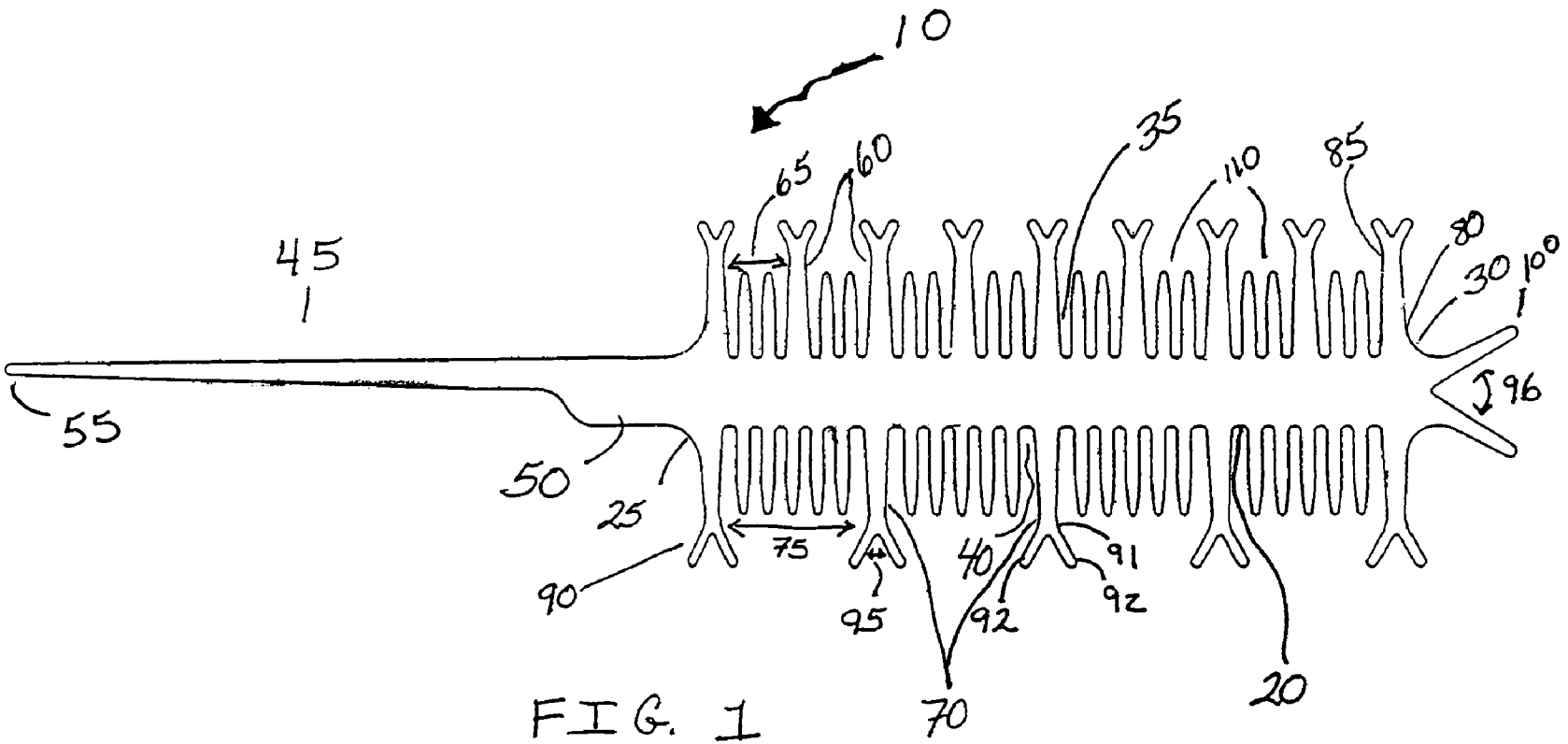
FIG. 1 and FIG. 1A are side views of the highlighting comb of the present invention.
Figure 1A:
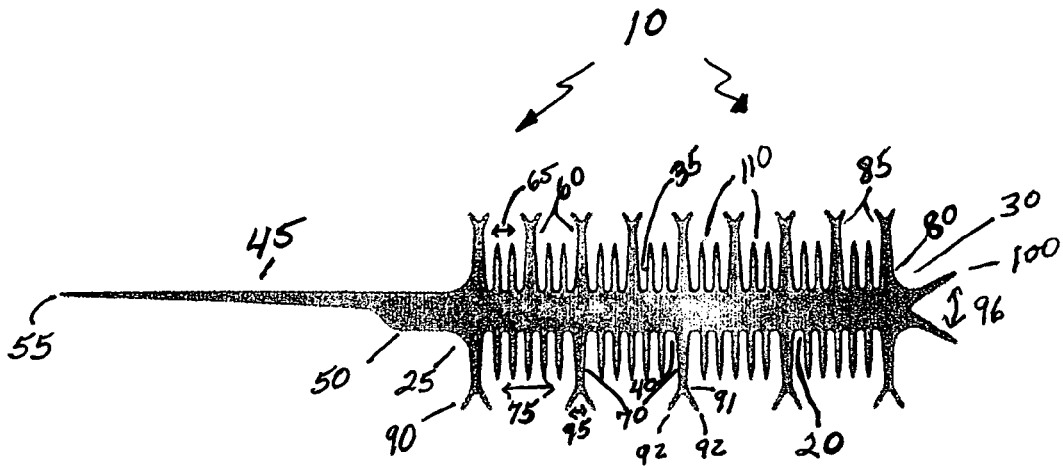

Referring to the drawing, a highlighting comb 10 of the present invention consists of a comb spine 20 with an elongated body having a first spine end 25, a second opposed spine end 30, opposed upper and lower surfaces 35 and 40, respectively, in the portion of the body between the first and second spine ends. The first end 25 of the spine 20 is shaped into a handle 45 that extends outwardly from the first spine end and away from the second spine end. The handle 45 includes a toothless spine extension 50, which precipitously narrows, and forms a thumb rest. The handle 45 further extends and tapers from the spine extension 50. The section of handle 45 that tapers away from spine extension 50 is long and narrow and terminates at a tapered point 55 to form a "rattail". The purpose of the rattail is to section the hair by, for example, picking up a thin rectangular-like swatch of hair on the scalp with the pointed end of the tapered rattail extension.

Comb 10 further includes a first plurality of spaced apart major comb teeth 60 projecting outwardly from the upper surface 35 of the comb spine 20 and having a first spacing 65 between the major comb teeth. A second plurality of spaced apart major comb teeth 70 project outwardly from the lower surface 40 of the comb spine in a direction substantially opposite from the first plurality of teeth 60 and having a second spacing 75 between each pair of major comb teeth 70. In a preferred embodiment, the ratio of major comb teeth 60 on the upper surface 35 to major comb teeth 70 on the lower surface 40 is 9:5. However, the ratio of major comb teeth on either side of the spine can be changed, dependent upon the desired highlighting pattern. Each spacing in between the major comb teeth entrains strands of hair as the comb is pulled through a sectioned portion of hair.

Each tooth in the plurality of major comb teeth 60 and 70 has a fixed end 80 attached to the spine and a free end 85 shaped into a V-shaped notch 90 with the base of the notch 91 located at the free end 85 and the fork of the notch comprising a pair of diverging tines 92 extending outwardly and away from the free end and including an angle 95 between them.

In a preferred embodiment of comb 10, the first tooth spacing 65 differs from the second tooth spacing 75 thereby allowing each set of major comb teeth to entrain and therefore subsection a different width of hair in between each pair of major comb teeth as the comb is pulled through a sectioned portion of hair. In the preferred embodiment, the first plurality of major comb teeth 60 can have V-shaped notches with the included angle that is differentiated from the angle between the V-shaped notches of the second set of major comb teeth 70. However, the V-shaped notches on both sets of major comb teeth 60 and 70 can have the same size included angle. The V-shaped notches facilitate the flow of hair in between the forks of the notch as the comb is drawn through a section of hair, further segmenting the sub-sectioned hair into strands in between the tines of the fork, the included angle in between the tines defining the thickness of the strands entrained therein.

Comb 10 also provides for a V-shaped notch 100 located at the end 30 of the spine, the tines of the notch extending outwardly from end 30 and directed away from the end 20 of the spine. Notch 100 has a larger included angle 96 than the notches 90 described above and therefore is suited to entrain a thicker strand of hair for highlighting.

In a preferred embodiment of the invention, the spaces between adjacent pairs of major comb teeth may be occupied by one or more sets of minor teeth 110. Teeth 110 have a proximal end attached to an upper or lower surface of the spine and a distal end located outwardly from the surface and free from the spine, the teeth 110 without V-shaped notches at their distal ends. Minor teeth 110 preferably have a smaller overall length and distance in between them is smaller than the plurality of major comb teeth 60 and 70. These teeth may serve to keep the combed hair sub-sectioned in between the major comb teeth into parallel ordered strands as the comb is drawn through the hair. In a preferred embodiment, the ratio of minor teeth between major comb teeth 60 and major comb teeth 70 is 2:5. However, this ratio can be changed dependent upon the desired highlighting pattern.

Comb 10 is easy to use and does not require complicated manipulation of the comb in order to entrain a section of hair for treatment. There are no levers to slide nor any need to shift the comb in a particular direction in order to entrain the hair. A common combing stroke is used when using the hairstyling comb. The notches in the major comb teeth smoothly catch the hair to be treated, with little tangling or snarling of the hair. Tangled or snarled hair would necessitate starting the procedure over again or, if the hair was treated anyway, it would result in an undesirable thickness and pattern of treated hair.

Comb 10 provides the user with more control over which strands of hair are treated. Brushes, caps, and combs that apply hair treatment, may not provide the user with adequate control over which hair strands are treated with hair treatment. With the hairstyling comb of the present invention, the user can choose the pattern of highlighting, dependent upon which side of the comb is used and which of the entrained strands of hair are subsequently treated with hair treatment. The user can change the pattern of hair treatment by simply using one of the other sides of the hairstyling comb, thus easily varying the pattern of highlighting in the hair.

In a preferred method of use of the hairstyling comb of the current invention, the rattail section of the comb 55 is inserted below a segment of combed hair and a rectangular segment of hair is lifted up and isolated from the rest of the hair on the scalp. This segment of hair is picked up and the comb is run through it perpendicular to the hair section. The notches in the major comb teeth 70, 60 will then catch certain strands of hair. These strands are picked up and a foil 120 placed underneath them. The strands are covered with hair color or bleach and the foil is folded in half to contain the strands until the color processing is complete. The end results are salon beautiful foiled highlights.

Figure 2:
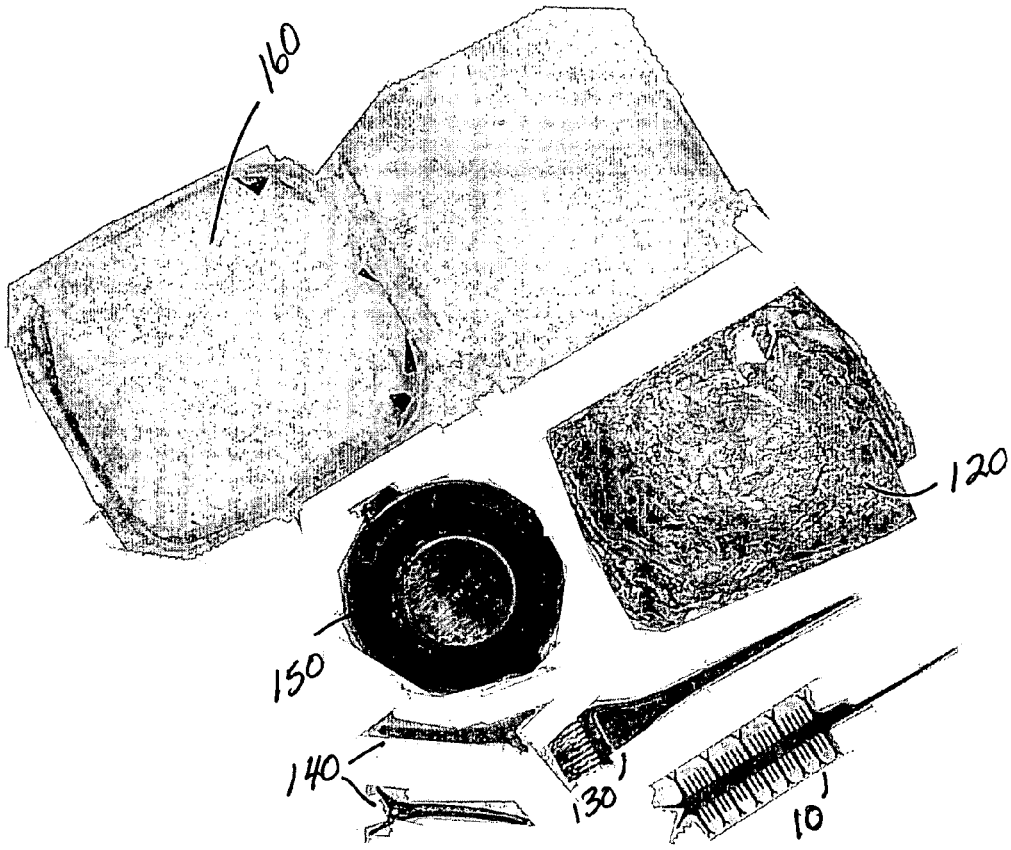
FIG. 2 is a top view of the components of the hairstyling kit of the present invention.
Figure 3:
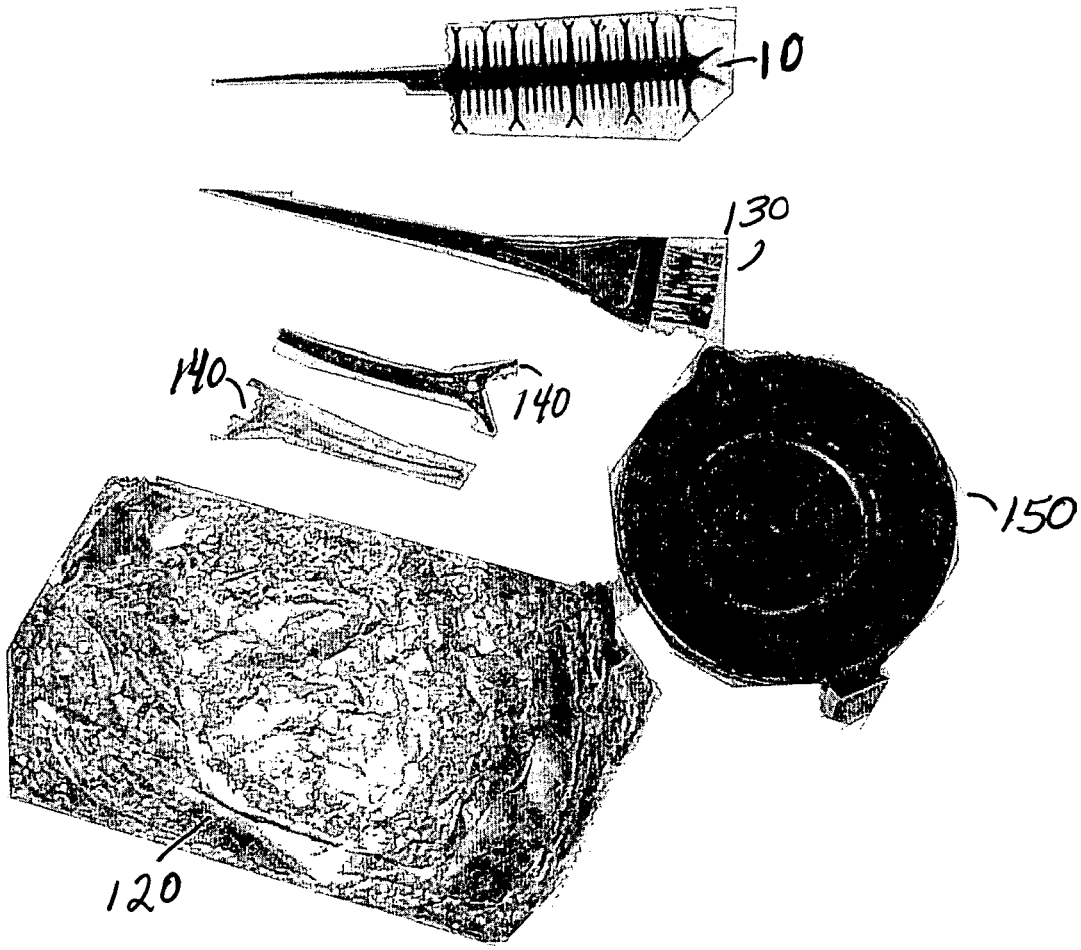
FIG. 3 is a top view of the components of the hairstyling kit according to the present invention.
Figure 4:
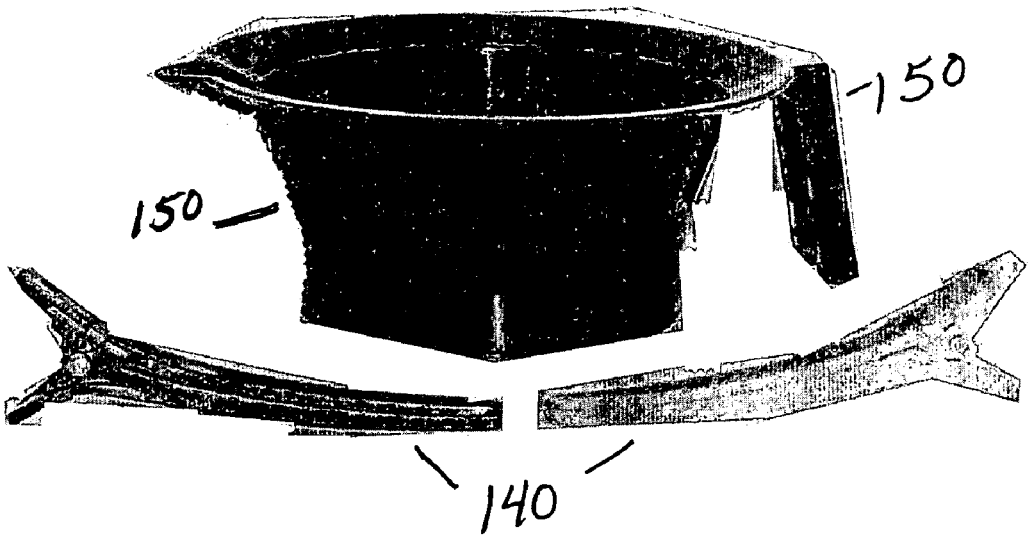
FIG. 4 is a side view of two of the components of the hairstyling kit according to the present invention.
Figure 5:
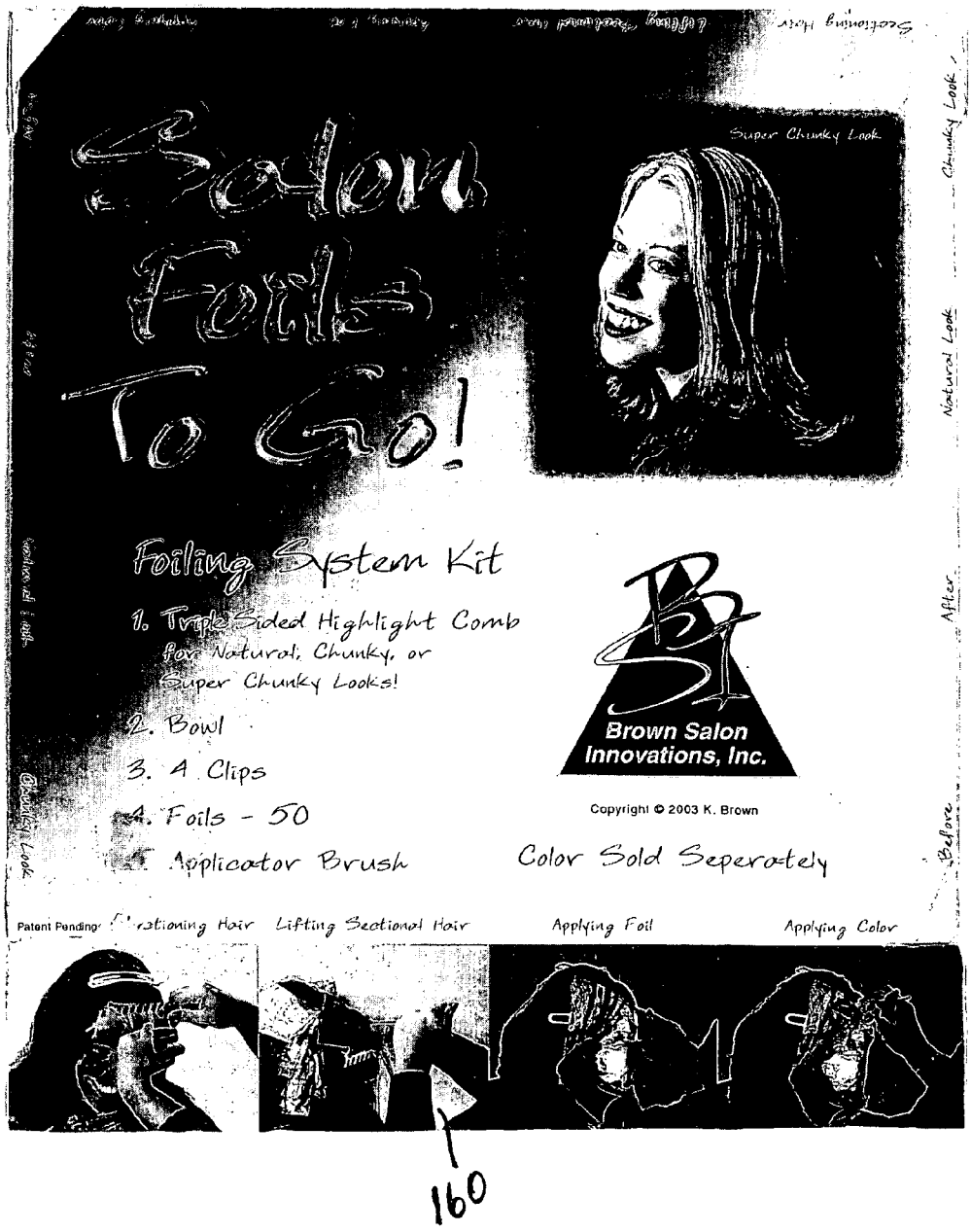
FIG. 5 is a top view of the instruction sheet for the use of the hairstyling comb according to the present invention.

Referring now to FIGS. 2–5, hairstyling comb 10 of the present invention may be a component of a hair-highlighting kit. The kit provides the various apparatus required to perform hair highlighting. Components of the kit can include the hairstyling comb of the present invention 10, a bowl or other shaped container 150 for mixing the hair treatment, clips 140 for holding strands of hair, foils 120, a hair treatment application brush 130 and instructions for use of the hairstyling comb 160. The kit provides the basic apparatus to perform hair highlighting. The user provides the particular type of hair treatment that is to be applied, such a particular hair color, bleach or other treatment designed for application to the hair.

Although the foregoing description illustrates preferred embodiments of the present invention and its method of use, it should be appreciated that the invention also covers various embodiments that incorporate the inventive concepts underlying the invention. It will be appreciated by those skilled in the art that various modifications may be made without departing from the scope and spirit of the inventive concept and that the invention is not limited to the particular form described herein.

The invention claimed is:

1. A hairstyling comb comprising:

a spine having a first end, a second end and opposed upper and lower surfaces;

a tapered comb tail extending from the first end of the spine;

the second end of the spine having a V-shaped notch, the V-shaped notch comprising tines that extend outwardly from the second end of the spine and form an angle therebetween;

a plurality of spaced-apart major comb teeth arranged longitudinally along the upper and lower surfaces of the spine, each of the major comb teeth having a spine end attached to the spine and a free end extending distally from the spine, the free ends of the major comb teeth each containing a V-shaped notch, the V-shaped notch comprising a fork and a base, the base located at the free end of the major comb tooth, the fork of the V-shaped notch comprising a pair of diverging tines extending outwardly from the free end of the major comb tooth and containing an angle between the tines; and at least one minor comb tooth arranged in a space between spaced-apart major comb teeth.

2. The hairstyling comb of claim 1, further comprising a thumb rest, the thumb rest integral to the spine and located intermediate the first end of the spine and the tapered comb tail.

3. The hairstyling comb of claim 1, wherein the angle between the tines of the V-shaped notch located at the second end of the spine is greater than the angle between the tines of the V-shaped notches on the major comb teeth.

4. The hairstyling comb of claim 1, wherein the tines of the V-shaped notches on the major comb teeth of the upper surface of the spine have a first size and the tines of the V-shaped notches on the major comb teeth of the lower surface of the spine have a second size.

5. The hairstyling comb of claim 1, wherein the angle between the tines of the V-shaped notches on the major comb teeth of the upper surface of the spine has a first size and the angle between the tines of the V-shaped notches on the major comb teeth of the lower surface of the spine has a second size.

6. The hairstyling comb of claim 1, wherein the spacing between the major comb teeth on the upper surface of the spine of the comb is greater than the spacing between the major comb teeth on the lower surface of the spine of the comb.

7. A hairstyling kit comprising:

a hairstyling comb comprising a spine having a first end, a second end, and opposed upper and lower surfaces, a tapered comb tail extending from the first end of the spine;

the second end of the spine containing a V-shaped notch, the V-shaped notch comprising tines that extend outwardly from the second end of the spine and form an angle therebetween;

a plurality of spaced-apart major comb teeth arranged longitudinally along the upper and lower surfaces of the spine, each of the major comb teeth having a spine end attached to the spine and a free end extending distally from the spine, the free ends of the major comb teeth each containing a V-shaped notch;

the V-shaped notch comprising a fork and a base, the base located at the free end of the major comb tooth;

the fork of the V-shaped notch comprising a pair of diverging tines extending outwardly from the free end of the major comb tooth and containing an angle between the tines;

at least one minor comb tooth arranged in a space between spaced-apart major comb teeth;

a container adapted to hold a liquid;

hair clips;

foils;

an application brush; and instructions for use of the hairstyling comb.

* * * * *